United States Patent [19]

Teshima et al.

[11] 4,183,506

[45] Jan. 15, 1980

[54] PROTECTIVE DEVICE FOR TURBINE DRIVEN BY EXHAUST GAS FROM BLAST FURNACE

[75] Inventors: Kiyomi Teshima; Yukimasa Kajitani, both of Tamano, Japan

[73] Assignees: Mitsui Engineering & Shipbuilding Co., Ltd.; Nippon Steel Corporation, both of Tokyo, Japan

[21] Appl. No.: 835,303

[22] Filed: Sep. 21, 1977

[51] Int. Cl.[2] ..... C21D 11/00

[52] U.S. Cl. ..... 266/88; 60/39.55; 266/147

[58] Field of Search ..... 60/39.54, 39.55; 266/44, 87, 88, 89, 144, 147, 197

[56] References Cited

U.S. PATENT DOCUMENTS

| | | | |
|---|---|---|---|
| 2,995,895 | 8/1961 | Howes | 60/39.55 |
| 3,304,074 | 2/1967 | Atherton | 266/197 X |
| 3,747,335 | 7/1973 | Strub | 266/197 X |
| 3,832,845 | 9/1974 | Aguet | 60/39.55 X |
| 3,982,878 | 9/1976 | Yamane et al. | 60/39.55 X |
| 4,067,557 | 1/1978 | Inubushi et al. | 266/89 |

FOREIGN PATENT DOCUMENTS

| | | | |
|---|---|---|---|
| 2631977 | 1/1977 | Fed. Rep. of Germany | 266/44 |
| 391180 | 12/1973 | U.S.S.R. | 266/89 |

*Primary Examiner*—Paul A. Bell
*Attorney, Agent, or Firm*—Armstrong, Nikaido, Marmelstein & Kubovcik

[57] ABSTRACT

A device for protecting a turbine driven by an exhaust gas of a blast furnace from a high temperature gas generated and discharged when the blow-out phenomenon takes place in the blast furnace is disclosed. In this protective device, occurrence of the blow-out phenomenon is detected, and cooling water is sprayed in an exhaust gas or in the turbine to lower the temperature of the gas, or cooling water is directly sprayed to a part of a material which readily undergoes thermal degradation to cool the material.

10 Claims, 4 Drawing Figures

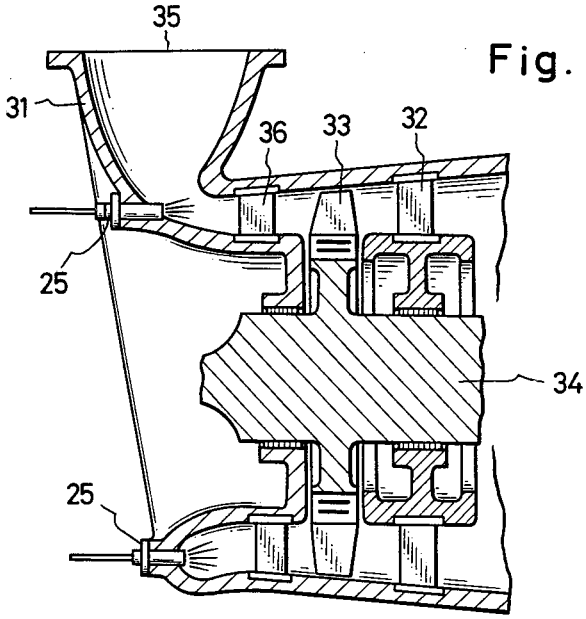
Fig. 3
Fig. 4
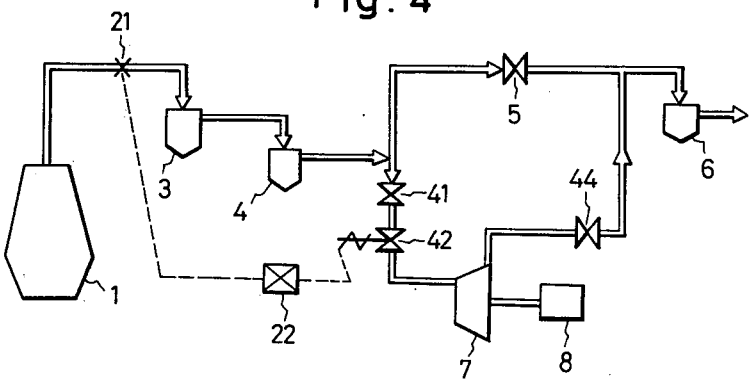

PROTECTIVE DEVICE FOR TURBINE DRIVEN BY EXHAUST GAS FROM BLAST FURNACE

BACKGROUND OF THE INVENTION

An exhaust gas discharged in a large quantity from a blast furnace is maintained at a high temperature and a considerably high pressure. When the blast furnace exhaust gas is washed with water in a dust precipitator or the like disposed downstream, the temperature is lowered to a level approximating to ambient temperature but it still retains a sufficient pressure energy. In iron manufacturing plants, one of the important problems is how to attain the energy-saving effect how to effectively recover such pressure energy possessed by a blast furnace exhaust gas.

As a most conveniently workable method for recovery of such pressure energy, there can be mentioned a method in which a turbine is driven by utilizing the blast furnace exhaust gas and a power generator is driven by this turbine to convert the pressure energy to electric energy.

This energy recovery method, however, still involves problems to be solved. In the first place, the pressure or amount discharged of the blast furnace exhaust gas is not constant, but in general, it is readily changed depending on the resistance in the blast furnace, namely depending on the molten state of ore or the flow state of blast furnce slag. During the operation in the blast furnace, a part of the packed material is molten and coagulated and is often suspended in the blast furnace. When this suspended state becomes impossible to keep, the coagulated mass is let to fall down and a large quantity of a high temperature gas is blown out at a time. Namely, the so-called "blow-out" phenomenon is caused to occur.

In the normal operation of the blast furnace, the temperature of the gas at the outlet of the blast furnace is 200° to 250° C. Since this high temperature is cooled by water sprayed from a venturi scrubber or the like of a dust precipitator disposed between the outlet of the blast furnace and the turbine, the temperature of the gas at the inlet of the turbine is lowered to 60° to 80° C. However, when the blow-out phenomenon takes place, the temperature of the gas at the inlet of the turbine is elevated to 250° C. or higher. Accordingly, because of elongation of the turbine rotor or moving blade or uneven distortion of a casing, such undesirable phenomenon as abnormal contact of the top end of the moving blade with the casing is caused to occur or the overload is imposed on the power generator.

Secondarily, dusts contained in the exhaust gas adhere to the transportation passage or the turbine, especially a stationary blade thereof, and these dusts disturb gas flows and reduce the efficiency of the turbine.

As means for preventing adhesion and accumulation of dusts to the casing inlet and stationary blade of the turbine, there is adopted a method in which parts to which dusts are likely to adhere are coated with a material having a good parting property, such as a fluorine resin, a phenolic resin or crystalline metal oxide ceramics.

When the interior of the turbine is coated with such material having a good parting property, it is possible to prevent adherence of dusts and resulting reduction of the efficiency of the turbine, but because such coating material lacks heat resistance or readily undergoes thermal degradation, if the above-mentioned "blow-out" phenomenon takes place in the blast furnace, by a high temperature gas instantaneously introduced into the transportation passage and the turbine, the coating material is thermally degraded.

In the blast furnace, packed materials such as ore change their shapes moment by moment, and therefore, it is impossible to prevent occurrence of the "blow-out" phenomenon. Accordingly, the turbine system must be designed and arranged so as to cope with this unavoidable "blow-out" phenomenon.

OBJECT OF THE INVENTION

It is a primary object of the present invention to provide a protective device for a turbine which can protect the turbine and other equipments even when the blow-out phenomenon takes place in a blast furnace, by maintaining the temperature of a blast furnace gas introduced into the turbine and other members at a predetermined level, whereby the operation of the turbine is made possible even when the blow-out phenomenon takes place and the overall efficiency of recovery of the energy by a power generator is enhanced.

Another object of the present invention is to provide a protective device for a turbine in which if continuous operation of the turbine becomes impossible because of occurrence of the blow-out phenomenon in a blast furnace, introduction of a blast furnace gas into the turbine is interrupted by closing a shut off valve.

BRIEF SUMMARY OF THE INVENTION

According to the present invention, the foregoing objects are attained by a protective device for a turbine in which occurrence of the blow-out phenomenon in a blast furnace is promptly detected and in response to a detection signal, cooling water is sprayed in the interior of the turbine or to a transportation pipe passage for an exhaust gas disposed between the blast furnace and the turbine, thereby to maintain the termperature of the exhaust gas within a predetermined range.

In general, the temperature of the blast furnace exhaust gas at an inlet portion of the turbine is 60° to 80° C. but when the blow-out phenomenon takes place, it rises to about 250° C. and simultaneously, the gas pressure is elevated. Accordingly, in the present invention, this increase of the exhaust gas temperature and/or elevation of the exhaust gas pressure is detected, and in response to the detection signal, a cooling water spraying device is operated.

The position for detecting rising of the exhaust gas temperature or elevation of the exhaust gas pressure is selected in view of the moving speed of the exhaust gas so that the cooling water spraying device can be operated without any substantial time lag from the point of occurrence of the blow-out phenomenon. Namely, means for detecting rising of the exhaust gas temperature or elevation of the exhaust gas pressure is disposed at the top of the blast furnace or in a piping in the vicinity thereof. Electric sensing means and electric signal-transmitting means are preferably used as means for detecting the temperature or pressure and means for transmitting a detection signal, respectively.

Most conspicuous changes caused by the blow-out phenomenon are those of the temperature and pressure. In addition, the composition of the exhaust gas and the combustion state are considerably influenced by the blow-out phenomenon. In the present invention, means for detecting the change of the temperature and/or pressure is most appropriate for detecting occurrence of the blow-out phenomenon, but means for detecting changes of such factors as the composition of the exhaust gas and the combustion state may similarly be adopted.

A water spraying device is most preferred as means for cooling the high temperature exhaust gas. More specifically, water requires a large quantity of latent heat for evaporation, and since the exhaust gas has passed through the dust-removing step including a dust collector and a venturi scrubber and is then fed to the turbine, a considerable amount of water is contained in the exhaust gas fed to the turbine and even if water is applied to the exhaust gas for lowering the temperature, no particular problem or disadvantage is brought about. In the present invention, water may be fed in the form of a mixture with an agent for protecting the interior of the turbine or with other additives according to need.

In general, water spraying means is disposed at an inlet of the turbine, but it may be located at other part of the pipe passage.

It is preferred that water is sprayed in the atomized state under a high pressure so that it is instantaneously dispersed and gasified in the exhaust gas. The amount sprayed of water is controlled so that the temperature of the exhaust gas fed to the turbine is maintained within the range of 60° to 80° C. However, this temperature range differs to some extent according to the characteristics of the turbine and the turbine-constituting material. Accordingly, the amount sprayed of water is appropriately determined depending on the turbine actually employed.

When the turbine or the exhaust gas transportation pipe passage is formed of a material insufficient in the heat resistance, water is directly sprayed to a part of such material to prevent rising of the temperature at said part and also prevent thermal degradation of the material.

In the present invention, since occurrence of the blow-out phenomenon in the blast furnace is detected and water is sprayed into the exhaust gas in response to a detection signal, the temperature of the exhaust gas can be effectively maintained at a predetermined level and hence, uneven distrotion by thermal expansion of the interior of the turbine can be prevented. Therefore, a material which readily undergoes thermal degradation, disposed in the exhaust gas transportation pipe passage or turbine, can be effectively protected and the turbine can be stably operated at high efficiency and the energy possessed by the exhaust gas can be effectively recovered.

Further, if water is directly sprayed to a part where thermal degradation is likely to occur, the piping system can be protected efficiently.

Still in addition, in the present invention, if continuous operation of the turbine becomes impossible by the blow-out phenomenon, introduction of the exhaust gas into the turbine can be interrupted by closing a shut off valve.

BRIEF DESCRIPTION OF THE DRAWING

The drawings illustrate embodiments of the present invention, in which:

FIG. 3 is a sectional side view showing a gas inlet portion of a turbine; and FIG. 4 is a diagram illustrating means for spraying cooling water to a gas flow passage leading to a turbine, by utilizing the change of the gas temperature.

DETAILED DESCRIPTION OF PREFERRED EMBODIMENTS

Figure 1:
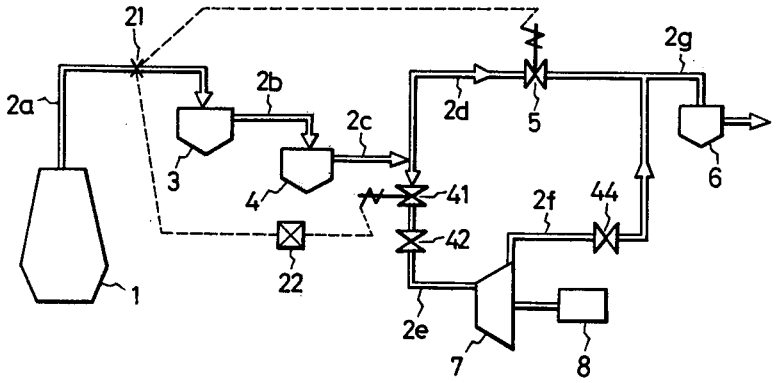
FIG. 1 is a diagram illustrating means for actuating an emergency shut off valve on receipt of a signal indicating occurrence of the blow-out phenomenon to intercept the flow of an exhaust gas into a turbine.
Figure 2:
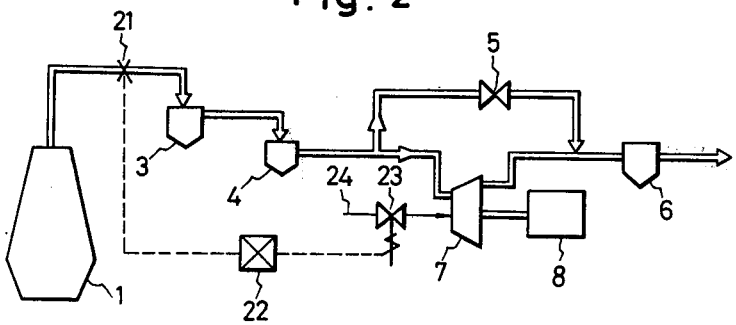
FIG. 2 is a diagram illustrating means for spraying cooling water into a turbine on receipt of a signal indicating occurrence of the blow-out phenomenon.

FIGS. 1, 2 and 4 are systematic diagrams illustrating embodiments of the protective divice of the present invention for protecting a turbine driven by a blast furnace exhaust gas from the blow-out phenomenon caused in a blast furnace. In the drawing, a double line indicates the flow system of an exhaust gas from a blast furnace, a solid line indicates the flow system of cooling water, and a dot line represents an electric control circuit.

The objects of the present invention can be attained according to the following methods:

(I) An emergency shut off valve is closed to intercept the flow of the gas to the turbine:

(II) Cooling water is sprayed in the interior of the turbine:

(III) Cooling water is sprayed to a gas flow passage leading to the turbine.

These three methods (I), (II) and (III) will now be described in detail.

Referring now to FIG. 1, the method (I) is first described. In this embodiment, an exhaust gas introduced through an exhaust gas pipe *2a* connected to the top of a blast furnace 1 is fed to a dust collector 3 where most of dusts contained in the exhaust gas are removed therefrom. Then, the exhaust gas is fed to a venturi scrubber 4 through an exhaust gas pipe *2b*. In this venturi scrubber 4, the exhaust gas is treated with water or a chemical solution so that it will not cause any trouble, e.g., corrosion, at subsequent steps. A main exhaust gas pipe passage *2c* is branched into a gas flow passage *2e* to the turbine and a gas flow control passage *2d*. The gas flow control passage *2d* is extended to a second venturi scrubber 6 through a septum valve 5. This second venturi scrubber 6 may be disposed just after the first venturi scrubber 4. The gas flow passage *2e* to the turbine is connected to a turbine 7 and the exhaust gas fed to the turbine 7 is fed to the second venturi scrubber 6 through an exhaust gas flow passage *2f*. A power generator 8 or other load is connected to the turbine 7, and the energy possessed by the exhaust gas is recovered through the power generator 8 or the like.

Means for detecting the temperature or pressure, namely a temperature or pressure relay 21, is disposed in the exhaust gas pipe *2a* at a portion close to the blast furnace 1 and a signal generated by the relay 21 is transmitted through an electric control circuit 22 to control an emergency shut off valve 41. Reference numeral 42 represents a governor valve for controlling the gas flow to the turbine, and reference numeral 44 represents a shut off valve disposed at an outlet of the turbine.

In the protective device having the above structure, an exhaust gas discharged from the blast furnace 1 is first introduced in the dust collector 3 where coarse dust particles are precipitated and separated. Then, the gas flow is introduced into the venturi scrubber 4 where considerable proportions of fine dust particles are removed by spraying of water or a chemical solution and the temperature of the gas is lowered to such a level that the gas can be used in the turbine, namely 60° to 80° C.

The flow rate of the gas passing through the gas flow control passage 2*d* is controlled by the septum valve 5 so that the pressure of the blast furnace pressure is maintained at a certain level irrespectively of the load on the turbine 7. The exhaust gas from the turbine 7 joins the gas flow from the passage 2*d*, and the combined gas is fed to a subsequent gas-utilizing plant through the second venturi secubber 6 and an exhaust gas flow passage 2*g*.

The temperature or pressure relay 21 is disposed to detect an abrupt change of the temperature or pressure of the exhaust gas caused by the blow-out phenomenon in the blast furnace 1. It is preferred that the sensing part of the relay 21 be composed of a material which is not degraded even if always exposed to dust-containing exhaust gas, and that the surface of the sensing part of the relay 21 be covered with a crystalline metal oxide ceramic coating and the coating surface be polished so as to prevent adherence and deposition of dusts.

The temperature or pressure relay 21 may be disposed at any part of the pipe passage laid out between the blast furnace 1 and the turbine 7. However, in order to assure a sufficient time from the point of detection of a temperature or pressure change by the blow-out phenomenon to the point of arrival of an abnormally high temperature gas at the turbine 7 and provide a sufficient spare time for actuation of the turbine-protective device, it is preferred that the relay 21 be disposed at a part as close to the blast furnace 1 as possible.

In the foregoing embodiment, when the blow-out phenomenon takes place in the blast furnace 1, abnormal elevation of the temperature or pressure is detected by the relay 21 to close the emergency shut off valve 41 and open the septum valve 5, whereby introduction of the gas into the turbine 7 is intercepted. Since the operation time of the emergency shut off valve is much shorter than that of the septum valve, there may arise a fear of elevation of the pressure in the entire system. However, since the volume of the entire system is large, in general, this elevation of the pressure is not significant.

In the foregoing first embodiment (I), the turbine 7 is not operated when the blow-out phenomenon takes place and the above protective means is actuated. In contrast, in the embodiment (II) where cooling water is sprayed in the interior of the turbine and the embodiment (III) where cooling water is sprayed to the gas flow passage leading to the turbine, the turbine can be operated continuously even if the blow-out phenomenon takes place. The embodiment (II) where cooling water is sprayed in the interior of the turbine is now described by reference to FIGS. 2 and 3.

FIG. 2 is a systematic diagram similar to FIG. 1. In FIG. 2, the turbine is provided with a water spraying device, and reference numerals 23 and 24 represent a water pouring valve and a cooling water pipe, respectively. When occurrence of the blow-out phenomenon is detected by the pressure or temperature relay 21, the water pouring valve 23 is opened on receipt of a detection signal to sprinkle cooling water in the interior of the turbine and lower the gas temperature instantaneously to a predetermined level.

FIG. 3 is a sectional view showing the main part of the embodiment where cooling water is sprayed into the turbine 7. Referring to FIG. 3, a rotor boss 34 is rotatably supported at the center of a casing 31 and a moving blade 33 is fixed to the periphery of the rotor boss 34. Further, a stationary blade 32 is mounted on the casing 31. A cooling water spraying nozzle 25 is mounted in the vicinity of a gas supply opening 35 so that cooling water is sprayed to a first stage stationary blade 36 fixed to the casing 31. Cooling water sprayed from the nozzle 35 is dispersed in the gas flowing in the casing 31 and receives heat therefrom and evaporates, whereby the temperature of the gas is lowered to a predetermined level.

It is most preferred that the cooling water spraying nozzle 25 be disposed at a part for feeding the exhaust gas to the turbine as shown in FIG. 3. If the temperature of the gas is thus lowered by spraying of cooling water, elevation of the temperature at the respective members of the turbine is reduced at a lowest level and degradation of a material poor in the heat resistance, for example, a coating layer formed on the stationary blade or the like to prevent adhesion of dusts, can be effectively prevented. Moreover, there can be attained an effect of removing dusts adhering onto the stationary blades and the inlet portion of the casing.

If it is intended only to lower the temperature of the gas fed to the turbine to a predetermined level, the cooling water spraying nozzle may be disposed at a position other than the above-mentioned point. For example, it may be disposed at any part of the exhaust gas pipe passage laid out from the blast furnace to the turbine.

As a special embodiment of the present invention, there can be adopted a method in which the temperature of a part which readily undergoes thermal degradation is locally lowered. For example, when the first stage stationary blade is coated with a material which is likely to undergo thermal degradation, cooling water is sprayed to protect only the area of the coating. In this embodiment, the amount of water to be sprayed can be reduced, but in many cases the temperature of the gas passing through the turbine is not so lowered. However, thermal degradation of the part that is likely to undergo thermal degradation can be effectively prevented.

When the blow-out phenomenon takes place in the blast furnace, because of elevation of the temperature and pressure, the output of the turbine is increased. Accordingly, when the capacity of the power generator is limited, it is necessary to adopt any means coping with this increase of the output of the turbine. It is possible to cope with the elevation of the pressure by opening and closing the septum valve and governor valve according to a customary control, but special arrangement should be made to cope with the increase of the output of the turbine caused by the rising of the temperature. In the present invention, a temperature relay 21 is disposed as shown in FIG. 4, and a control circuit 22 is arranged so that when the temperature detected by the relay 21 exceeds a predetermined lelvel, the governor valve is closed to a degree corresponding to the excess of the temperature over the predetermined level. By this arrangement, it is made possible to prevent an excessive load from being imposed on the power generator.

In the embodiment (III), the water spraying means is located in the pipe passage upstream of the turbine. This embodiment (III) is advantageous over the embodiment (II) in the point that disposition of water spraying means is facilitated, a plurality of water spraying nozzles may be mounted and maintenance of the water spraying means can be done with ease. At any rate, in both the embodiments (II) and (III), in order to facilitate lowering of the gas temperature, it is necessary to atomize the water spray.

What is claimed is:

1. In connection with a blast furnace of the type subject to a blow-out phenomenon, a protective device for a turbine adapted to be driven by exhaust gas generated in said blast furnace, said protective device comprising spraying means for spraying cooling water to a gas transportation passage between said blast furnace and said turbine, and detection means for sensing the blow-out phenomenon in said blast furnace, said spraying means being activated on receipt of a signal from said detecting means.

2. A protective device as set forth in claim 1 wherein the cooling water-spraying position is the gas inlet portion of the turbine.

3. A protective device as set forth in claim 1 wherein said detection means capable of sensing and detecting occurrence of the blow-out phenomenon in the blast furnace is means sensing the change of the temperature and/or pressure of the exhaust gas.

4. A protective device as set forth in claim 1 wherein a stationary blade of the turbine is coated with a material which prevents adherence of dust and cooling water is sprayed to the vicinity of a gas feed inlet of the turbine.

5. A protective device as set forth in claim 1 wherein a passage for the exhaust gas from the blast furnace is branched into a part for feeding the exhaust gas to the turbine and a part for controlling the flow of the exhaust gas so that a predetermined amount of the exhaust gas is supplied to the turbine.

6. In connection with a blast furnace of the type subject to a blow-out phenomenon, an apparatus adapted for feeding an exhaust gas generated in said blast furnace to a turbine and driving said turbine by the action of said exhaust gas, said turbine including portions coated with material preventing adhesion of dust, said material readily undergoing thermal distortion or degradation, a system for protecting said thermally distortable or degradable material from damage due to said blow-out phenomenon in said blast furnace comprising detecting means for sensing and detecting the occurrence of said blow-out phenomenon in said blast furnace and spraying means activated in response to said detecting means sensing the occurrence of said blow-out phenomenon for spraying water on said thermally distortable or degradable material in said turbine.

7. In connection with a blast furnace of the type subject to a blow-out phenomenon, a protective device for a turbine driven by exhaust gas generated in said blast furnace, said protective device comprising spraying means for spraying cooling water to the interior of said turbine, and detection means for sensing said blow-out phenomenon in said blast furnace, said spraying means being activated on receipt of a signal from said detecting means.

8. A protective device as set forth in claim 7 wherein said detection means capable of sensing and detecting occurrence of the blow-out phenomenon in the blast furnace is means sensing the change of the temperature and/or pressure of the exhaust gas.

9. A protective device as set forth in claim 7 wherein a stationary blade of the turbine is coated with a material which prevents adherence of dust, and cooling water is sprayed to the vicinity of a gas feed inlet of the turbine.

10. A protective device as set forth in claim 7 wherein a passage for the exhaust gas from the blast furnace is branched into a part for feeding the exhaust gas to the turbine and a part for controlling the flow of the exhaust gas so that a predetermined amount of the exhaust gas is supplied to the turbine.

* * * * *